US011692559B2

(12) United States Patent
Luo et al.

(10) Patent No.: US 11,692,559 B2
(45) Date of Patent: Jul. 4, 2023

(54) MICRO HYDRAULIC SUSPENSION MECHANICAL PUMP AND ASSEMBLING METHOD THEREOF

(71) Applicant: HUAZHONG UNIVERSITY OF SCIENCE AND TECHNOLOGY, Hubei (CN)

(72) Inventors: Xiaobing Luo, Hubei (CN); Guanying Xing, Hubei (CN); Hao Zou, Hubei (CN); Tao Hong, Hubei (CN); Yiwen Fan, Hubei (CN); Weiwei Liao, Hubei (CN); Song Xue, Hubei (CN)

(73) Assignee: HUAZHONG UNIVERSITY OF SCIENCE AND TECHNOLOGY, Hubei (CN)

( * ) Notice: Subject to any disclaimer, the term of this patent is extended or adjusted under 35 U.S.C. 154(b) by 0 days.

(21) Appl. No.: 17/972,553

(22) Filed: Oct. 24, 2022

(65) Prior Publication Data

US 2023/0126883 A1 Apr. 27, 2023

(30) Foreign Application Priority Data

Oct. 25, 2021 (CN) ..... 202111239534.6

(51) Int. Cl.
*F04D 29/42* (2006.01)
*F04D 29/62* (2006.01)
(Continued)

(52) U.S. Cl.
CPC ..... *F04D 29/4293* (2013.01); *F04D 13/06* (2013.01); *F04D 13/0606* (2013.01);
(Continued)

(58) Field of Classification Search
CPC .... F04D 13/06; F04D 13/0613; F04D 29/042; F04D 13/0606; H02K 5/10; H02K 5/128; H02K 7/14; H02K 9/197
See application file for complete search history.

(56) References Cited

U.S. PATENT DOCUMENTS 3,135,211 A * 6/1964 Pezzillo ..... F04D 13/0613 417/357
2011/0027112 A1* 2/2011 Negishi ..... H02K 5/1282 417/423.12
(Continued)

FOREIGN PATENT DOCUMENTS

CN 106762694 5/2017
CN 106949069 7/2017
(Continued)

*Primary Examiner* — Dominick L Plakkoottam
(74) *Attorney, Agent, or Firm* — JCIPRNET

(57) ABSTRACT

The invention discloses a micro hydraulic suspension mechanical pump structure and an assembling method thereof. The hydraulic suspension micro pump includes a volute, an upper end cap, a positioning sheet, an impeller, a hollow cup motor, a waterproof cover, and a rotor. The hollow cup motor includes a motor casing, a motor bottom cap, a magnet rotor, a coil, and an iron core. The waterproof cover is in a separated state from the motor, and a lower part has a positioning boss to implement radial cooperation with a recess at a corresponding position of the motor. At the same time, there is the sheet between the recess and the boss to implement axial positioning of the waterproof cover.

7 Claims, 3 Drawing Sheets

(51) Int. Cl.
*F04D 13/06* (2006.01)
*F04D 29/042* (2006.01)

(52) U.S. Cl.
CPC ..... *F04D 13/0613* (2013.01); *F04D 29/042* (2013.01); *F04D 29/628* (2013.01)

(56) References Cited

U.S. PATENT DOCUMENTS

2016/0290340 A1* 10/2016 Maurino ..... F04D 15/0038
2019/0226485 A1* 7/2019 Luo ..... F04D 13/0633

FOREIGN PATENT DOCUMENTS

CN 106989050 7/2017
CN 106949069 B * 11/2017

* cited by examiner

MICRO HYDRAULIC SUSPENSION MECHANICAL PUMP AND ASSEMBLING METHOD THEREOF

CROSS-REFERENCE TO RELATED APPLICATION

This application claims the priority benefit of China application serial no. 202111239534.6, filed on Oct. 25, 2021. The entirety of the above-mentioned patent application is hereby incorporated by reference herein and made a part of this specification.

BACKGROUND

Technical Field

The disclosure relates to the field of mechanical pumps, and more particularly relates to a micro hydraulic suspension mechanical pump and an assembling method thereof.

Description of Related Art

With the increasing integration of electronic equipment, more and more electronic elements are integrated in a unit area, which means that the amount of heat generation per unit area increases accordingly, the large-scale use of active thermal control systems is inevitable, and the micro pump is the core driving apparatus of the active thermal control system. At the same time, as an important research direction of micro electromechanical systems, micro mechanical pumps are also widely used in fields such as chemical transport systems, special pumping systems, and medical equipment.

At present, most vane-type micro pumps in the industry include bearings, and the bearings cause mechanical friction and lead to wear. For work scenarios such as data center servers that work non-stop, liquid-cooling micro pumps are required to operate continuously for a long time. It is extremely challenging to design bearings with little or no wear under such long-term high-speed operation. In response to this, researchers have designed different forms of suspension micro pumps using the principle of hydraulic suspension or magnetic suspension, so that the traditional bearing structure can be completely dismissed and the issue of wear of bearings at high rotational speeds can be effectively solved. The magnetic suspension bearing may adopt an active control solution and a permanent magnet suspension solution. The active control solution needs to use a sensor to capture the position of a rotor and feedback a position signal to an auxiliary coil, which generates a balance force to keep the rotor in a suspended state at all times. However, the system structure of such solution is complex, the energy loss is larger, and the heat generation is serious. For the permanent magnet suspension solution, although the system is simple and the assembling requirements are not high, suspension with full degrees of freedom cannot be implemented.

The hydraulic suspension technology can suspend the rotor with full degrees of freedom through the hydrodynamic action of the fluid inside the pump. For example, the hydraulic suspension micro pump as disclosed in CN106949069A and CN106762694A implements the axial suspension through the hydraulic spiral groove thrust bearing. During the installation process of such thrust bearing, due to the very high requirements of levelness of the moving ring and the static ring, the assembly becomes a difficult issue, and the processing precision requirements of the spiral groove is also extremely high. The hydraulic suspension micro pump as disclosed in CN106989050A cleverly utilizes the characteristics of the flow field inside the micro pump to implement stable axial suspension without any thrust bearing.

However, since the rotating vanes of the micro pump move axially within a certain range due to changes in the flow field during the operation process, thereby scratching the stationary parts, the adjustment of the axial position of the vanes becomes the key to stable suspension. For the micro pump as disclosed in CN106989050A, the only adjustment manner is to manually adjust the axial distance between the vanes and the magnet rotor, so that the impeller is at a proper position of the pump chamber to ensure that the impeller does not scratch the stationary parts within a wide range of working conditions. However, such operation needs to be repeatedly performed during the assembling process, and the parts inside the micro pump need to be continuously disassembled, which inevitably causes damage to the parts. Also, such manner relies on debugging only through experience, which is very time consuming.

In summary, although the conventional hydraulic suspension pump can implement suspension and frictionless operation, the cumbersome assembling process due to the defects of the structural design reduces the yield, increases the production cost, and limits the large-scale application.

SUMMARY

Aiming at the structural deficiencies and the assembling difficulties of the conventional hydraulic suspension mechanical pump, the disclosure provides a suspension-enhanced hydraulic suspension mechanical pump and a matching assembling method thereof, which has the advantages of simple structure, convenient operation, and can adapt to the operation of changing working conditions to greatly improve the reliability of the micro mechanical pump.

In order to implement the above objective, according to an aspect of the disclosure, a hydraulic suspension mechanical pump is provided, which includes a volute, a sealing gasket, an upper end cap, a waterproof cover, a positioning sheet, a hollow cup motor, an impeller, a rotor sleeve, a shaft cover, and a motor bottom cap.

The volute is provided with a water inlet channel and a water outlet channel, an inner space of the volute serves as a pump chamber, and the water inlet channel and the water outlet channel are respectively communicated with the pump chamber. A lower end of the waterproof cover is closed, and an upper end is open and is provided with a flange.

The hollow cup motor includes a motor casing, an iron core, a coil, and a magnet rotor. The iron core is installed on a side wall of the motor casing, an inner wall of the iron core is sheathed with the coil, and an inner hole of the coil is sheathed with the waterproof cover to prevent liquid from flowing into the coil. The waterproof cover is in a separated state from the motor casing, and a lower part of the flange of the waterproof cover has a positioning boss to implement radial limitation in cooperation with a recess at a corresponding position of the hollow cup motor. The positioning sheet is installed between the recess and the positioning boss, and axial positioning of the waterproof cover is implemented through adjusting the number and/or the thickness of the positioning sheet. The volute and the motor casing are fixedly connected, the sealing gasket is disposed between an upper end surface of the waterproof cover and the volute, and the waterproof cover is also used to carry the upper end cap. The upper end cap is provided with a circumferential water inlet communicated with the pump chamber to allow water to flow into the waterproof cover, the rotor sleeve is sleeved onto an outer side of the magnet rotor, and the shaft cover is fixedly sleeved onto an inner hole wall surface of the magnet rotor. The magnet rotor is located in the waterproof cover, a rotating shaft of the impeller passes through a middle water outlet to be cooperatively connected to an inner wall of the shaft cover, and the vanes of the impeller are located in the pump chamber. There is a first gap between an inner side wall of the shaft cover and an outer side surface of the rotating shaft of the impeller as a first water flow channel, and the first water flow channel is communicated with the pump chamber. There is a second gap between an outer side wall of the rotor sleeve and an inner side wall of the waterproof cover as a second water flow channel, and the second water flow channel is communicated with the circumferential water inlet.

Further, the motor casing is provided with a concave platform with a relatively low height and the iron core higher than the concave platform to jointly form the recess to cooperate with the positioning boss.

Further, an inner diameter of the positioning boss is greater than an outer diameter of the iron core, and an interference fit is formed between an outer surface of the positioning boss and an inner wall surface of the concave platform of the motor casing.

Further, an outer surface of the rotor sleeve is processed with multiple straight grooves with alternating concavities and convexities.

Further, an outer diameter of the positioning sheet is less than an outer diameter of the positioning boss, and an inner diameter is greater than an outer diameter of the iron core.

In order to implement the above objective, according to another aspect of the disclosure, an assembling method of the micro hydraulic suspension mechanical pump is provided, which includes the following steps.

In step 1, the magnet rotor is fixedly connected to the rotor sleeve and the shaft cover.

In step 2, a shaft end of the impeller is passed through the middle water outlet of the upper end cap to be inserted into an inner hole of the shaft cover connected to the magnet rotor, and an insertion depth of the impeller is adjusted to a predetermined initial position. Then, the magnet rotor is placed into an inner hole of the waterproof cover, and the upper end cap is fixedly connected to the waterproof cover.

In step 3, the volute is installed and fixed on the upper end surface of the waterproof cover, and the pump is then operated. According to a position of the vane of the impeller in the pump chamber, the waterproof cover is taken out, and the number and/or the thickness of the positioning sheet are then increased or decreased until the vane of the impeller does not scratch a plane of the upper end cap or the volute during the operation process. At this time, adjustment of an axial position of the micro pump rotor is completed.

In step 4, the waterproof cover is locked to complete axial assembly of a rotor.

Further, if an initial installation position is not correct, when the vane scratches downward against the upper end cap during operation, the pump chamber is moved downward relative to the impeller through decreasing the number or the thickness of the positioning sheet, so that the impeller does not scratch any stationary part. On the contrary, the pump chamber is moved upward relative to the impeller through increasing the number or the thickness of the positioning sheet, so that the impeller does not scratch any stationary part.

In general, compared with the prior art, the above technical solutions conceived by the disclosure can obtain the following beneficial effects.

1. The waterproof cover 4 and the motor casing 6 adopt a separated design, and the boss structure designed on the lower side surface of the waterproof cover 4 cooperates with the recess structure of the motor casing 6 and the iron core 8, which can ensure the concentricity of the rotor in the waterproof cover 4. The axial position of the waterproof cover 4 and the volute 1 can be quantitatively and accurately controlled through increasing or decreasing the number or the thickness of the positioning sheet 5. Compared with the original manual adjustment of the relative positions of vanes of the impeller 7 and the volute 1, the assembling efficiency can be greatly improved, no damage to the parts is caused, and the yield can be greatly improved.

2. The radial suspension of the hydraulic suspension micro pump is implemented through the wedge-shaped gap formed between the stator and the rotor. However, during the operation process of the micro pump, external vibrations may exceed the bearing capacity of the radial suspension structure, so there is also the risk of a suspension failure. Therefore, the radial suspension force of the hydraulic suspension micro pump is enhanced through the optimized design, so that the operation stability can be greatly improved. In the disclosure, the straight grooves with alternating concavities and convexities are disposed on the outer side wall of the rotor sleeve 10 in the circumferential direction. On the one hand, a backflow shock can be formed when the liquid flows through the outer wall of the rotor sleeve 10, thereby increasing the radial suspension force and enhancing shock resistance. On the other hand, a liquid film between the rotor sleeve 10 and the waterproof cover 4 can be disturbed, thereby enhancing the heat dissipation capability of the motor to ensure the operation reliability of the micro pump.

DETAILED DESCRIPTION OF DISCLOSED EMBODIMENTS

In order for the objectives, technical solutions, and advantages of the disclosure to be clearer, the disclosure will be further described in detail below with reference to the drawings and the embodiments. It should be understood that the specific embodiments described herein are only used to explain the disclosure, but not to limit the disclosure. In addition, the technical features involved in the various embodiments of the disclosure described below may be combined with each other as long as there is no conflict therebetween.

Figure 1:
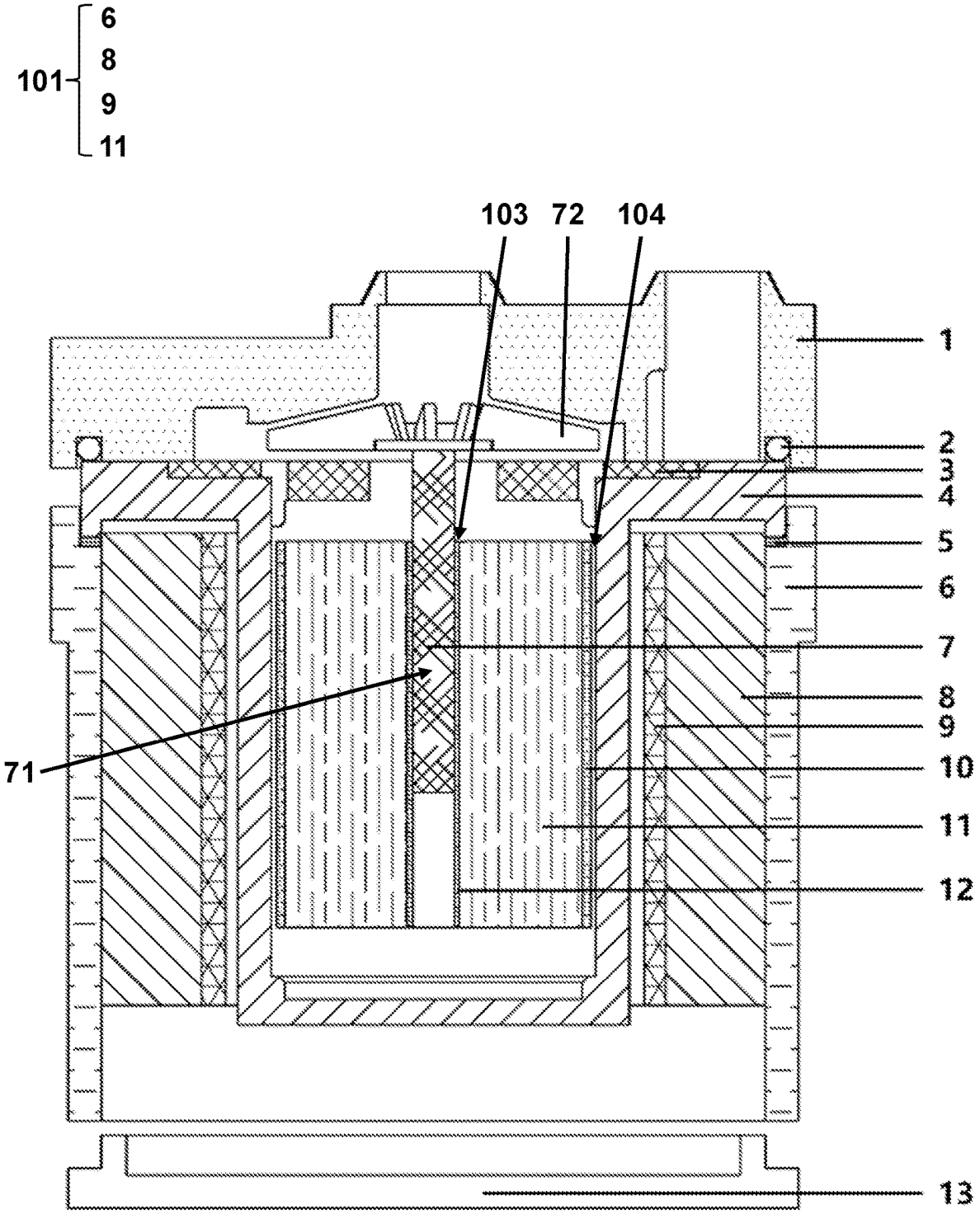
FIG. 1 is a structural schematic view of the disclosure.
Figure 2:
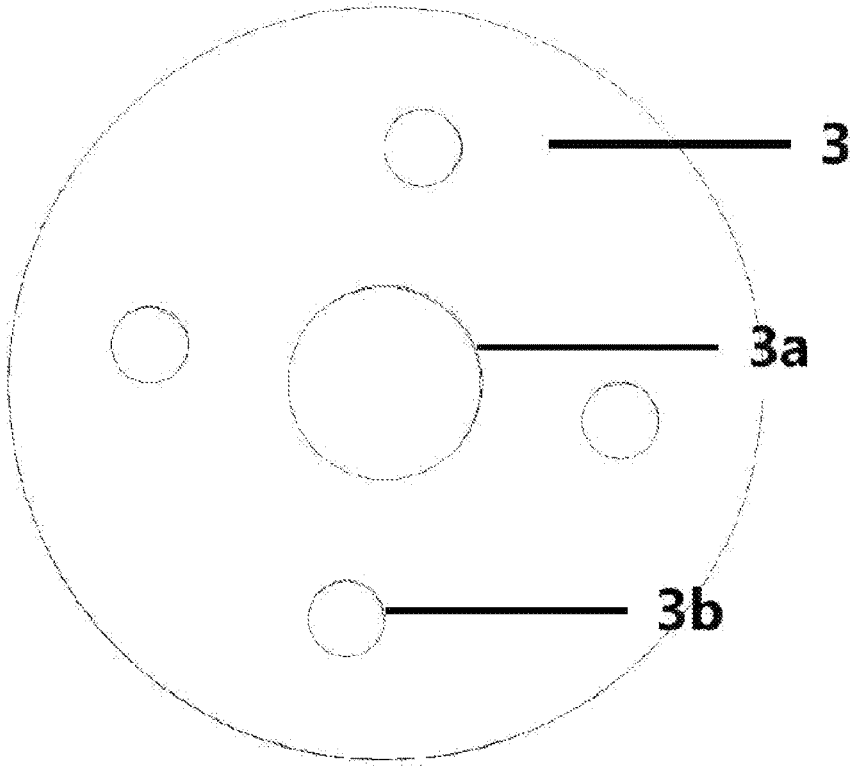
FIG. 2 is a sectional schematic view of an upper end cap of the disclosure.
Figure 3:
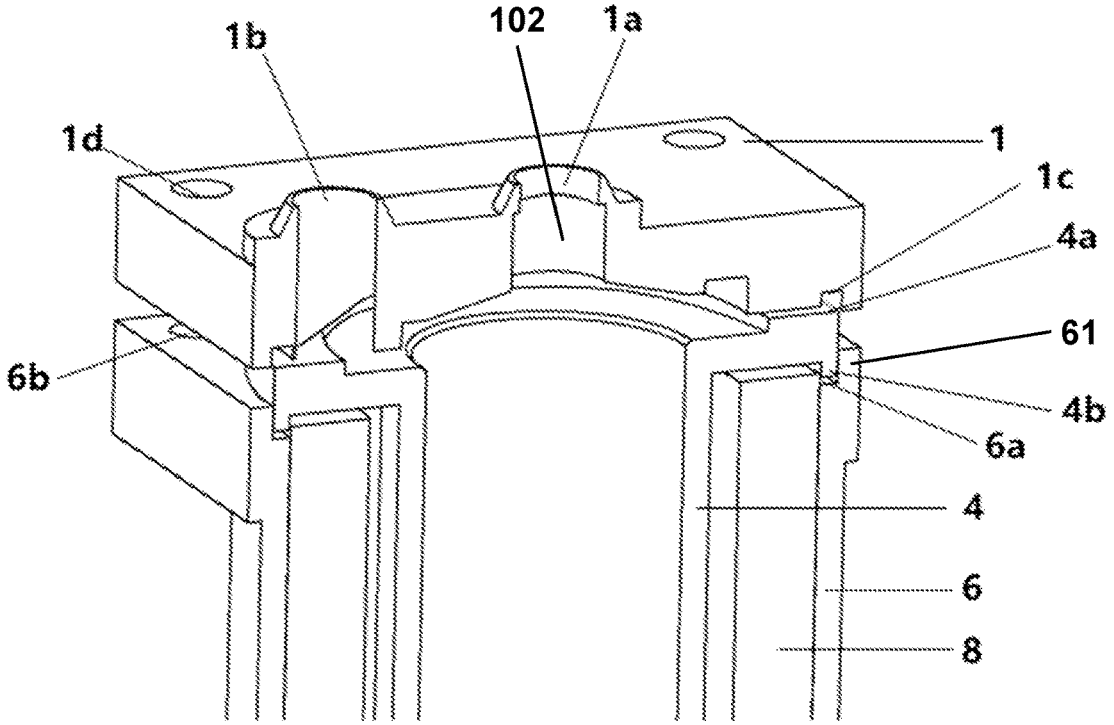
FIG. 3 is a sectional view of an axial position of a motor casing, a waterproof cover, and a volute in the disclosure.
Figure 4:
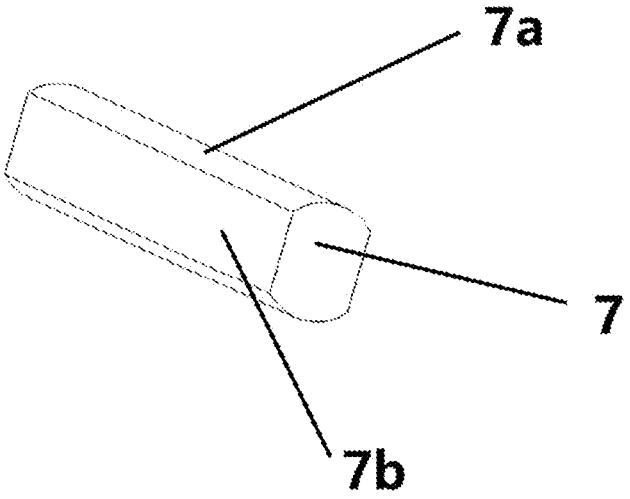
FIG. 4 is a structural schematic view of a shaft structure of an impeller in the disclosure.
Figure 5:
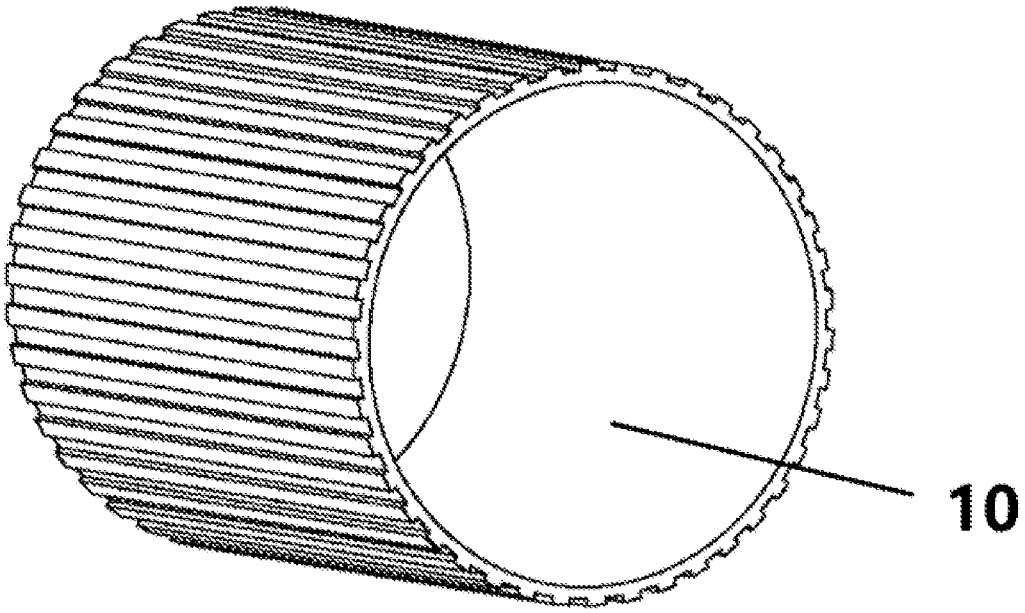
FIG. 5 is a structural schematic view of a rotor sleeve in the disclosure.

Referring to FIG. 1 to FIG. 4, a micro hydraulic suspension mechanical pump includes a volute 1, a sealing gasket 2, an upper end cap 3, a waterproof cover 4, a positioning sheet 5, a hollow cup motor, an impeller 7, a rotor sleeve 10, a shaft cover 12, and a motor bottom cap 13.

The volute 1 is provided with a water inlet channel 1*a* and a water outlet channel *b*, an inner space of the volute 1 serves as a pump chamber 102, and the water inlet channel 1*a* and the water outlet channel 1*b* are respectively communicated with the pump chamber 102. A large part of a fluid entering the mechanical pump mainly flows out through such manner, and a small part enters the inside of the waterproof cover 4 to implement the suspension function and take away heat.

The hollow cup motor 101 includes a motor casing 6, an iron core 8, a coil 9, and a magnet rotor 11. The iron core 8 is installed on a side wall of the motor casing 6, an inner wall of the iron core 8 is sheathed with the coil 9, and an inner hole of the coil 9 is sheathed with the waterproof cover 4 to prevent liquid from flowing into the coil 9 of the motor. The waterproof cover 4 in a separated state from the motor casing 6, a lower part of a flange thereof is provided with a positioning boss 4*b*, and the motor casing 6 is provided with a concave platform 61 with a relatively low height and the iron core 8 higher than the concave platform 61 to jointly form a recess 6*a* to cooperate with the positioning boss 4*b*. Preferably, in the embodiment, an interference fit is formed between the positioning boss 4*b* and a side wall of the recess 6*a*, so as to adjust the axial position and retain a certain radial limitation function. At the same time, a certain number of the positioning sheet 5 are placed between the recess 6*a* of the motor casing 6 and the positioning boss 4*b* on the waterproof cover 4 to implement the axial positioning of the waterproof cover 4. In the embodiment, the positioning sheet 5 is preferably a silicone sheet, an outer diameter is 0.15 mm less than an outer diameter of the waterproof cover boss 4*b*, and an inner diameter is 0.15 mm greater than an outer diameter of the iron core, so as to be picked and placed, the thickness is 0.1 mm, and the above material and sizes may all be set according to the actual situation and are not limited thereto. Through increasing or decreasing the number or the thickness of the positioning sheet 5, the relative positions of the waterproof cover 4 and the volute 1 cooperating therewith may be adjusted.

An upper end surface of the waterproof cover 4 is also provided with an upper part positioning boss 4*a* to cooperate with a volute recess 1*c* at a corresponding position of the volute 1, and the sealing gasket 2 is disposed therebetween. In the embodiment, the volute 1 and the motor casing 6 are fixedly connected together through a screw. Also, a stepped groove is provided in a middle part of the waterproof cover 4 and is used to carry the upper end cap 3. The upper end cap 3 is provided with a circumferential water inlet 3*b* communicated with the pump chamber 102, so as to allow water to flow into the waterproof cover 4.

The rotor sleeve 10 with concave-convex straight grooves processed on the surface is sleeved onto an outer side of the magnet rotor 11, and the shaft cover 12 is fixedly sleeved onto an inner hole wall surface of the magnet rotor 11. The magnet rotor 11 is located in the waterproof cover 4, a rotating shaft 71 of the impeller 7 passes through a central hole of the upper end cap 3 to be cooperatively connected to an inner wall of the shaft cover 12, and vanes 72 of the impeller 7 are located in the pump chamber 102. There is a first gap between an inner side wall of the shaft cover 12 and an outer side of the rotating shaft 71 of the impeller 7 as a first water flow channel 103, and the first water flow channel 103 is communicated with the pump chamber 102. There is a second gap between an outer side wall of the rotor sleeve 10 and an inner side wall of the waterproof cover 4 as a second water flow channel, and the second water flow channel 104 is communicated with a middle water outlet 3*a* of the upper end cap 3. A small part of the water flow enters the waterproof cover 4 from the second water flow channel, flows through a side wall, an inner wall, and upper and lower end surfaces of the magnet rotor 11, and then flows into the pump chamber 102 from the middle water outlet 3*a* of the upper end cap, so as to generate a radial and axial liquid film flow to provide a suspension force while taking away the heat of the motor.

There is a third gap between the magnet rotor 11 and the upper end cap 3, and the third gap allows water to flow into the third gap to generate an axial thrust on the magnet rotor 11.

The iron core 8 is disposed between the coil 9 and the motor casing 6, and the iron core 8 and the coil 9 can generate a magnetic force with the magnet rotor 11, thereby jointly cooperating with the thrusts of the water at a top part and a bottom part of the magnet rotor 11 on the magnet rotor 11, so as to limit the axial displacement of the magnet rotor 11.

In order to implement the reliable installation of the impeller 7, in the disclosure, an interference fit is formed between a shaft end of the impeller 7 and the shaft cover 12 of an inner hole of the magnet rotor 11. Preferably, in the embodiment, the rotating shaft 71 of the impeller 7 may be processed by adopting a cylindrical shaft and cutting off a part of an outer side, so as to form a gap with the shaft cover 12, wherein 7a is a cooperating surface, 7*b* is a cutting surface, and the first water flow channel 103 is formed between the cutting surface 7*b* and the shaft cover 12.

The waterproof cover 4 and the volute 1 jointly form the pump chamber 102 of the micro pump. The upper part positioning boss 4*a* is disposed on a contact end surface of the waterproof cover 4 in contact with the volute 1, the volute 1 is correspondingly provided with the volute recess 1*c*, and the two are sealed by a sealing ring 2. In order to prevent mechanical interference caused by eccentric installation of the impeller 2 and adverse effects on performance, the motor casing 6 is provided with a threaded hole 6*b*, the volute 1 has a through hole 1*d* at a corresponding position, and the two are connected through a screw.

The working principle of the micro hydraulic suspension mechanical pump of the disclosure is as follows.

A radial hydrodynamic bearing can be formed between an outer wall of the rotor sleeve 10 and an inner wall of the waterproof cover 4 through a liquid film. In addition, when the liquid enters the gap between the magnet rotor 11 and the upper end cap 3, the liquid generates a downward thrust on the magnet rotor 11. When the liquid enters an inner bottom surface of the waterproof cover 4, an upward thrust is generated on the magnet rotor 11, thereby also generating a gap between the magnet rotor 11 and the waterproof cover 4. A resultant force of the downward and upward thrusts on the magnet rotor 11 coupled with the magnetic force of the magnet rotor 11 and the iron core 8 can limit the axial displacement of the magnet rotor 11 to implement suspension with full degrees of freedom and get rid of wear of bearings due to friction.

Based on the above working principle, since the rotating vanes of the micro pump move axially within a certain range due to changes in the flow field during the operation process, thereby scratching the stationary parts, the adjustment of the axial position of the vanes becomes the key to stable suspension.

Considering that the axial position of the magnet rotor 11 is stable within a certain range during stable suspension, the prior art is to manually adjust the axial distance between the vanes 72 of the impeller 7 and the upper end surface of the magnet rotor 11, that is, to adjust an insertion depth of the rotating shaft 71 of the impeller 7 into the magnet rotor, so as to change the height of the vanes of the impeller in the pump chamber 102 during stable suspension, so that the impeller is at a proper position in the pump chamber 102 to ensure that the impeller does not scratch the stationary parts within a wide range of working conditions. However, as described in the background section, on the one hand, such adjustment manner needs to disassemble parts such as the volute 1, the upper end cap 3, the waterproof cover 4, the impeller 7, the rotor sleeve 10, and the magnet rotor 11, which is cumbersome to operate and reduces the service life of the parts. On the other hand, due to the lack of monitoring means for the axial position of the impeller in the operation state, the axial distance between the vanes 72 of the impeller 7 and the upper end surface of the magnet rotor 11 can be debugged only through experience, which undoubtedly also increases the number of times of disassembling the parts, is time consuming, and further increases the risk of damage to the parts.

Therefore, the disclosure specifically provides to adopt a separated design for the waterproof cover 4 and the motor casing 6, that is, the waterproof cover 4 and the volute 1 are moved integrally without being disassembled, and the integral axial position may be quantitatively and accurately controlled through increasing or decreasing the number or the thickness of the positioning sheet 5. Since the axial position of the magnet rotor 11 is stable within a certain range in the stable hydraulic suspension state, the small integral movement of the waterproof cover 4 and the volute 1 does not destroy the stable suspension environment. Therefore, the integral up/down movement of the waterproof cover 4 and the volute 1 may also adjust the position of the vanes of the impeller in the pump chamber 102 to ensure that the impeller does not scratch the stationary parts within a wide range of working conditions. Therefore, compared with the prior art, the disclosure can greatly improve the assembling efficiency without causing damage to the parts and greatly improve the yield.

In addition, the outer side wall of the rotor sleeve 10 is provided with multiple straight grooves with alternating concavities and convexities in the circumferential direction. Such structure is simple to process and has the two following advantages. On the one hand, a backflow shock can be formed when the liquid flows through the outer wall of the rotor sleeve 10, thereby increasing the radial suspension force and enhancing shock resistance. On the other hand, the liquid film between the rotor sleeve 10 and the waterproof cover 4 can be disturbed, thereby enhancing the heat dissipation capability of the liquid on the motor.

Based on the above concept, the assembling steps of the disclosure are as follows.

In step 1, the magnet rotor 11 is fixedly connected to the rotor sleeve 10 and the shaft cover 12. Preferably, glue is used for adhesion and curing in the embodiment.

In step 2, the shaft end of the impeller 7 is passed through the central hole of the upper end cap 3 to be inserted into an inner hole of the shaft cover 12 connected to the magnet rotor 11, and the shaft of the impeller 7 is inserted into the inner hole of the magnet rotor 11 to reach a predetermined initial position. Then, the magnet rotor 11 is placed into an inner hole of the waterproof cover 4, and the upper end cap 3 is snapped into a matching hole of the waterproof cover 4. A certain number of the positioning sheet 5 is loaded in the recess 6*a*.

In step 3, the volute 1 is connected, so that the pump operates, and the number and/or the thickness of the positioning sheet 5 are increased or decreased according to a scratching condition of the vanes of the impeller. In a preferred embodiment, the scratching condition is improved through increasing or decreasing the number of the positioning sheet 5. For example, when it is found that the impeller 7 is scratching downward with the upper end cap 3 in the pump chamber 102, the waterproof cover 4 is taken out, and the pump chamber 102 may be moved downward relative to the impeller 7 through decreasing the number of the positioning sheet 5. When it is found that the vanes 72 of the impeller 7 scratch upward with the volute 1 in the pump chamber 102, the waterproof cover 4 is taken out, and the pump chamber 102 is moved upward relative to the impeller 7 by installing a new positioning sheet 5. The above steps are repeated until the impeller 7 neither scratches the upper end cap 3 nor the volute 1.

In step 4, after the impeller 7 is at a proper position in the pump chamber 102, the waterproof cover is locked to the motor casing 6. Preferably, in the embodiment, the locking manner is as follows. An adhesive is filled into the gap between the positioning sheet 5 and the recess 6*a* formed by the motor casing 6 and the iron core 8, the positioning boss 4*b* of the waterproof cover 4 is then loaded into the recess 6*a*, and the waterproof cover 4 is locked after the adhesive is cured. After the axial assembly of the rotor is completed, the motor bottom cap 13 is clamped to complete the assembly of the whole machine.

The characteristics are that when the micro hydraulic suspension mechanical pump works, a liquid enters the waterproof cover through the upper end cap, and a liquid film is formed between an outer wall of the rotor sleeve and an inner wall of the waterproof cover, so that rotating parts are radially suspended. The synergy is generated between the magnetic force from the winding coil and hydraulic forces from the flow field, making the magnet rotor suspend in all directions and greatly improving the life of the micro hydraulic suspension pump. The function of the positioning sheet is to precisely adjust relative positions of the impeller and a pump chamber to implement quick assembly.

Persons skilled in the art can easily understand that the above are only preferred embodiments of the disclosure and are not intended to limit the disclosure. All modifications, equivalent replacements, improvements, etc. made within the spirit and principle of the disclosure should be included within the protection scope of the disclosure.

What is claimed is:

1. A micro hydraulic suspension mechanical pump, comprising: a volute, a sealing gasket, an upper end cap, a waterproof cover, a positioning sheet, a hollow cup motor, an impeller, a rotor sleeve, a shaft cover, and a motor bottom cap, wherein the volute is provided with a water inlet channel and a water outlet channel, an inner space of the volute serves as a pump chamber, and the water inlet channel and the water outlet channel are respectively communicated with the pump chamber; a lower end of the waterproof cover is closed, and an upper end is open and is provided with a flange;

the hollow cup motor comprises a motor casing, an iron core, a coil, and a magnet rotor; the iron core is installed on a side wall of the motor casing, an inner wall of the iron core is sheathed with the coil, and an inner hole of the coil is covered with the waterproof cover to prevent liquid from flowing into the coil; the waterproof cover is in a separated state from the motor casing, and a lower part of the flange of the waterproof cover has a positioning boss to implement radial limitation in cooperation with a recess at a corresponding position of the hollow cup motor, the recess is located on the motor casing; the positioning sheet is installed between the recess and the positioning boss, and axial positioning of the waterproof cover is implemented through adjusting a number and/or a thickness of the positioning sheet; the volute and the motor casing are fixedly connected, the sealing gasket is disposed between an upper end surface of the waterproof cover and the volute, and the waterproof cover is also used to carry the upper end cap; the upper end cap is provided with a circumferential water inlet communicated with the pump chamber to allow water to flow into the waterproof cover, the rotor sleeve is sleeved onto an outer side of the magnet rotor, and the shaft cover is fixedly sleeved onto an inner hole wall surface of the magnet rotor; the magnet rotor is located in the waterproof cover, a rotating shaft of the impeller passes through a middle water outlet of the upper end cap to be cooperatively connected to an inner side wall of the shaft cover, and a vane of the impeller is located in the pump chamber, there is a first gap between an inner side wall of the shaft cover and an outer side surface of the rotating shaft of the impeller as a first water flow channel, the first gap extends over a part of a radial portion of the rotating shaft, the first water flow channel is communicated with the pump chamber, there is a second gap between an outer side wall of the rotor sleeve and an inner side wall of the waterproof cover as a second water flow channel, and the second water flow channel is communicated with the circumferential water inlet.

2. The micro hydraulic suspension mechanical pump according to claim 1, wherein the motor casing is provided with a concave platform and the iron core higher than the concave platform to jointly form the recess to cooperate with the positioning boss.

3. The micro hydraulic suspension mechanical pump according to claim 2, wherein an inner diameter of the positioning boss is greater than an outer diameter of the iron core, and an interference fit is formed between an outer surface of the positioning boss and an inner wall surface of an upper concave portion of the motor casing.

4. The micro hydraulic suspension mechanical pump according to claim 1, wherein an outer surface of the rotor sleeve is processed with a plurality of straight grooves with alternating concavities and convexities.

5. The micro hydraulic suspension mechanical pump according to claim 1, wherein an outer diameter of the positioning sheet is less than an outer diameter of the positioning boss, and an inner diameter is greater than an outer diameter of the iron core.

6. An assembling method of the micro hydraulic suspension mechanical pump according to claim 1, comprising:

step 1, fixedly connecting the magnet rotor to the rotor sleeve and the shaft cover;

step 2, passing a shaft end of the impeller through the middle water outlet of the upper end cap to be inserted into an inner hole of the shaft cover connected to the magnet rotor, and adjusting an insertion depth of the impeller to a predetermined initial position; then placing the magnet rotor into an inner hole of the waterproof cover, and fixedly connecting the upper end cap to the waterproof cover;

step 3, installing and fixing the volute on the upper end surface of the waterproof cover, and then operating the pump; according to a position of the vane of the impeller in the pump chamber, taking the waterproof cover out, and then increasing or decreasing the number and/or the thickness of the positioning sheet until the vane of the impeller does not scratch a plane of the upper end cap or the volute during an operation process, wherein adjustment of an axial position of the micro pump rotor is completed at this time;

step 4, locking the waterproof cover to complete axial assembly of a rotor.

7. The assembling method of the micro hydraulic suspension mechanical pump according to claim 6, wherein if an initial installation position is not correct, when the vane scratches downward against the upper end cap during operation, the pump chamber is moved downward relative to the impeller through decreasing the number or the thickness of the positioning sheet, so that the impeller does not scratch any stationary part; when the vane scratches upward against the volute during operation, the pump chamber is moved upward relative to the impeller through increasing the number or the thickness of the positioning sheet, so that the impeller does not scratch any stationary part.

* * * * *